US011062690B2

(12) United States Patent
De Cesaris et al.

(10) Patent No.: US 11,062,690 B2
(45) Date of Patent: Jul. 13, 2021

(54) APPARATUS FOR THE ACTIVE CONTROL OF THE SOUND OF THE ENGINE OF A LAND VEHICLE AND CORRESPONDING METHOD

(71) Applicant: Magneti Marelli S.p.A., Corbetta (IT)

(72) Inventors: Simona De Cesaris, Corbetta (IT); Saverio Armeni, Corbetta (IT); Walter Nesci, Corbetta (IT); Massimo Ambrosino, Corbetta (IT); Pierangelo Pagliano, Corbetta (IT); Marco La Sana, Corbetta (IT)

(73) Assignee: Magneti Marelli S.p.A., Corbetta (IT)

( * ) Notice: Subject to any disclaimer, the term of this patent is extended or adjusted under 35 U.S.C. 154(b) by 0 days.

(21) Appl. No.: 16/225,379

(22) Filed: Dec. 19, 2018

(65) Prior Publication Data

US 2019/0206384 A1 Jul. 4, 2019

(30) Foreign Application Priority Data

Dec. 22, 2017 (IT) ..... 102017000149307

(51) Int. Cl.
*G10K 15/04* (2006.01)
*G10K 15/02* (2006.01)

(52) U.S. Cl.
CPC ..... *G10K 15/04* (2013.01); *G10K 15/02* (2013.01); *G10K 2210/1282* (2013.01); *G10K 2210/51* (2013.01)

(58) Field of Classification Search
CPC ..... G10K 15/00; G10K 15/02; G10K 15/04; G10K 2210/1282; G10K 2210/51; G10K 11/175; G10K 11/178
USPC ..... 381/56, 58, 71.1, 71.4, 86, 389
See application file for complete search history.

(56) References Cited

U.S. PATENT DOCUMENTS 5,635,903 A * 6/1997 Koike ..... A63H 17/34 340/384.1
10,373,600 B2 * 8/2019 Christoph ..... G10K 11/17854
2012/0148066 A1 6/2012 Honji et al.
2013/0304459 A1 * 11/2013 Pontoppidan ..... H03G 3/00 704/207

(Continued)

FOREIGN PATENT DOCUMENTS

DE 102011108124 A1 3/2012
FR 3026218 A1 3/2016

OTHER PUBLICATIONS

Zwicker, 1990, Psychoacoustics Facts and Models.*

(Continued)

*Primary Examiner* — William A Jerez Lora
(74) *Attorney, Agent, or Firm* — Howard & Howard Attorneys PLLC

(57) ABSTRACT

Described herein is an apparatus for active control of the sound of the engine of a land vehicle, which comprises a device for detecting a fundamental frequency of the sound of the engine, and comprises a generator of signals representing sound waves that have spectral characteristics that depend upon the aforesaid fundamental frequency. The apparatus comprises a modulator, which includes a module that applies a modulation to said waveforms so as to control a value of roughness or fluctuation strength of an audio signal for driving an actuator, which generates an engine noise.

15 Claims, 6 Drawing Sheets

(56) References Cited

U.S. PATENT DOCUMENTS

2014/0016792 A1* 1/2014 Christoph ..... G10K 15/02
381/61

OTHER PUBLICATIONS

Search Report for Italian Patent Application No. 201700149307 dated Sep. 25, 2018.
Zwicker, H. et al., Psychoacoustics. Facts and Models, Chapter 11: Roughness, pp. 257-264 (1990).

* cited by examiner

APPARATUS FOR THE ACTIVE CONTROL OF THE SOUND OF THE ENGINE OF A LAND VEHICLE AND CORRESPONDING METHOD

CROSS-REFERENCE TO RELATED APPLICATIONS

The present application claims priority to and all the benefits of Italian Patent Application No. 102017000149307, filed on Dec. 22, 2017, which is hereby expressly incorporated herein by reference in its entirety.

BACKGROUND OF THE INVENTION

1. Field of the Invention

The present invention relates to techniques for active generation of the sound of the internal-combustion or electric engine of a land vehicle, which comprises a device for detecting a fundamental frequency of the sound of the engine, and comprises a signal generator, which generates a plurality of signals representing sound waves that have spectral characteristics that depend upon a fundamental frequency and, in particular, also upon the state of the engine and a state of the accelerator pedal or of the torque produced by the engine.

2. Description of the Related Art

It is known to use in motor vehicles so-called ASP (Active Sound Profiling) systems, which have the aim of reproducing a given sound profile. ASP techniques can be adopted, for example, for improving the quality of sound inside the passenger compartment of a motor vehicle by modifying the engine noise inside the passenger compartment.

The aspects that refer to this need are multiple from the standpoint of the user and from the standpoint of the manufacturer. On the one hand, the passenger could expect to receive a particular sensation (provided also by the sound of the vehicle) inside the vehicle. On the other hand, the manufacturer could be interested in retaining the typical sound of the vehicle brand, even though modifications have been made that change the sound. The sensations originated by the sound of the vehicle are particularly correlated to the sound of the engine.

From the psycho-acoustic standpoint, this means finding a "recipe" capable of describing the perception of sound of the vehicle. Various formulas have been proposed, the majority of which present a combination of psycho-acoustic criteria regarding loudness, clarity, roughness, and fluctuation strength. In what follows, the terms "roughness" and "fluctuation strength" will be used.

In particular, roughness is used in engineering the quality of the sound in order to enhance the "sports-car" characteristic in the sound of the engine of a car.

Roughness is linked to the perception of the modulated sound for sounds modulated in the bandwidth from 20 Hz to 300 Hz and reaches a maximum at modulation frequencies of approximately 70 Hz when applied to a pure tone at 1000 Hz with maximum modulation depth. Fluctuation strength is similar to roughness, is correlated to modulation at frequencies lower than 20 Hz, and reaches a maximum at modulation frequencies of approximately 4 Hz. Roughness is linked to the timbre or colour, whereas fluctuation strength is linked to the rhythm.

In synthetic sounds, roughness and fluctuation strength can be regulated by applying a modulation to the generated sound.

In general, a rougher sound is perceived as more aggressive, this corresponding to a possible connotation of a sound that evokes the sound of a sports car. Hence, to obtain a perception of this sort on the part of the user it is deemed that a sound of the engine with high roughness values should be generated.

When the sound of the engine is generated directly by the vehicle engine, the increasing roughness values are correlated to the presence of orders of harmonics of the fundamental frequency $f_E$ of the engine that are half-integer multiples of the fundamental frequency $f_E$, namely, half-integer-order harmonics. In this regard, the engine orders k in general present integer values proportional to the number of strokes and cylinders of the engine. For instance, a four-stroke, four-cylinder engine has the first main engine order for k=2 and all the main harmonics for k=4, 6, 8 . . . . An order value k=1 corresponds to the fundamental frequency $f_E$, i.e., to the engine r.p.m. divided by sixty, namely the number of revolutions per second; for example, 1200 r.p.m. corresponds to a frequency of 20 Hz. The half-integer engine orders are all the orders for k=x+0.5, where x is an integer. In the example, the half-integer engine order k=5.5 corresponds to a frequency peak at 110 Hz.

In this framework, an apparatus for active control of the sound of the engine of a land vehicle of a known type comprises, for example, a converter for converting the engine r.p.m. into a value of fundamental frequency of a sinusoidal wave and comprises a generator of harmonics, which generates harmonics of sinusoidal waves as a function of an accelerator-pedal signal, for example the percentage of travel of the pedal when it is pressed by the driver, which is a signal representative of the engine torque. Moreover, supplied at input to the generator of harmonics is an engine state, i.e., an operating condition of the engine that is able to shape specifically the set of the harmonics that represent the engine noise, given the pedal or torque value; for example, the engine state may correspond to a cranking step or a heating step. The generator of harmonics will thus generate the harmonics also as a function of this information at input. Such an apparatus requires direct simulation of the engine noise, i.e., generation of a set of harmonics that constitutes the audio signal to be supplied to the speaker, directly introduced into which are the harmonics corresponding to the half-integer engine orders that are deemed necessary for emulating the "real" sound of the vehicle and for enabling a rougher sound to be obtained. Consequently, the aforesaid known apparatus substantially requires reproduction by the generator of an audio signal with a spectrum that as far as possible corresponds to that of the sound of the engine that it is desired to reproduce. Hence, the aforesaid apparatus is markedly constrained in the choices of the harmonics, and is thus far from flexible and does not enable precise and continuous control of the degree of roughness or other psycho-acoustic characteristics of the engine sound.

SUMMARY OF THE INVENTION

The object of the present invention is to provide an improved apparatus that will enable effective modelling of psycho-acoustic characteristics of the sounds synthesised starting from the characteristics of speed and torque of the engine of a vehicle.

According to the present invention, the above object is achieved by an apparatus for active control of the sound of the engine of a land vehicle, as well as by a corresponding method that presents the characteristics recalled specifically in the ensuing claims.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE INVENTION

Figure 1:
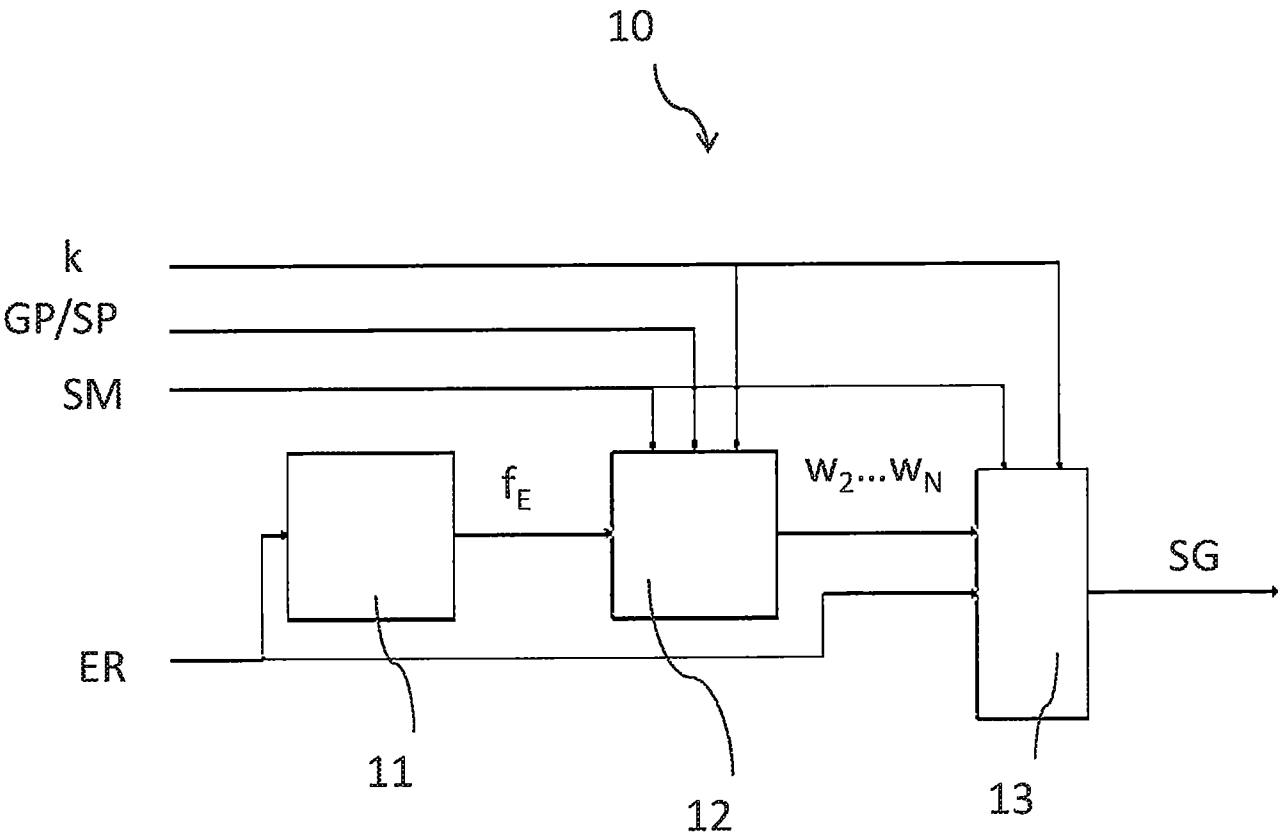
FIG. 1 is a principle diagram of the apparatus described herein.

In brief, the solution according to the invention regards an apparatus for active control of the sound of the engine of a land vehicle that comprises a generator of signals that represent sound waves having spectral characteristics that depend upon the engine r.p.m., in particular upon the frequency of revolution of the engine and upon the corresponding harmonic components. These signals are also a function of an accelerator-pedal signal and/or a signal representing the engine torque, and, preferably, also moreover a function of the engine state.

The above signals that represent sound waves can be synthesised starting from various types of waveforms, which comprise, inter alia, pure sinusoids, syncs, wavelets, and sound textures.

The above apparatus for active control comprises a modulator, which includes a module that applies a modulation to the aforesaid sound waves or to a combination of the latter so as to control a value of roughness or fluctuation strength of an audio signal for driving an actuator that generates an engine noise or sound. This sound may, for example, be combined with the noise of an internal-combustion engine, or else correspond to the engine noise in the case of an electric engine.

The apparatus described is hence able to modify the acoustic emission of the vehicle, both in the passenger compartment and in the exhaust line.

This is obtained by combining with the original sound of the vehicle a synthetic sound generated by the apparatus described.

In one embodiment, the apparatus described generates a sound wave synthesised as a function of the engine orders, which is directly correlated to the engine r.p.m., the state of the accelerator pedal and the torque, and the engine state. Hence, the present apparatus applies a modulation to the sound wave thus generated. This modulation produces, for example, a rough sound, which is generally perceived as more aggressive, and as presenting a noise that evokes the sound of a sports-car engine.

Hence, to obtain a rougher sound of the vehicle, instead of getting the synthesis of the sound wave to depend directly upon half-integer engine orders thus emulating the "real" behaviour of the vehicle, the apparatus described herein produces a given composition of sound waves that depend upon the integer engine orders, and directly determines the roughness of the sound by applying a modulation to the above composition, which in itself represents an audio signal that, via an acoustic actuator, reproduces an acoustic signal that corresponds to a desired generated final sound of the engine.

The apparatus described hence includes a generator of sound waves configured for depending upon a plurality of harmonics of the frequency of revolution of the engine. In one embodiment, the sound waves correspond to the basic sinusoidal harmonics of the frequency of revolution of the engine, or fundamental frequency. In addition, as has been said, the aforesaid sound waves are generated preferably as a function of other quantities that define the current engine state, the accelerator-pedal percentage displacement, possibly also a state of the accelerator pedal, and in any case a signal representing the engine torque, and moreover preferably also a signal representing the engine state. The sound waves synthesised by the aforesaid generator, in one embodiment, are combined, for example, via an adder, to obtain the composition of sound waves, to which, as has been mentioned, a respective modulation is then applied via a roughness-modulator block.

The above modulation may be an amplitude modulation or a frequency modulation. In the case of an amplitude modulation, the amplitude-modulation index (degree of modulation) and the amplitude-modulation frequency determine the roughness, whereas in the case of frequency modulation it is the frequency-modulation index and the modulation frequency of the modulating signal that determine the roughness of the resulting audio signal.

In this connection, illustrated in FIG. 1 is a principle diagram of the apparatus described herein, designated as a whole by the reference number 10. The components and modules included in this apparatus 10 are electronic modules that exchange signals, in particular electrical signals, and can be implemented via one or more processor modules, even included in one or more vehicle control units such as the ECU (Engine Control Unit) and/or electronic modules of a DSP (Digital Signal Processing) type. The apparatus 10 comprises a device for detecting a fundamental frequency $f_E$ of the sound of the engine, which is obtained via a converter 11, which receives, for example from the data network of the vehicle, i.e., a CAN bus, an engine speed ER, expressed as engine r.p.m. (revolutions per minute), and supplies at output a corresponding value of fundamental frequency of the engine $f_E$. It is here emphasised how conversion of the engine r.p.m. provides a very simple way of obtaining the fundamental frequency $f_E$ of the engine sound, given the relation with the frequency of revolution.

The above fundamental frequency $f_E$ is supplied at input to a generator 12 of signals that represent sound waves $w_2, \ldots, w_N$, in the sequel referred to, for brevity, as "sound waves $w_2, \ldots, w_N$". The spectral characteristics of these sound waves $w_2, \ldots, w_N$ supplied at output from the generator 12 are a function of the aforesaid fundamental frequency $f_E$. In the example described herein, these sound waves $w_2, \ldots, w_N$ correspond to the basic harmonics of a sinusoidal signal having the fundamental frequency $f_E$, i.e., sinusoidal signals that have frequencies that multiples of the fundamental frequency, namely, $2 \cdot f_E, 3 \cdot f_E, \ldots, n \cdot f_E$. Hence, the dependence of the spectral characteristics upon the fundamental frequency $f_E$ is in this case of a simpler type in so far as the sinusoidal waves $w_2, \ldots, w_N$ in the frequency domain are identified by spectral lines at frequencies that are multiples of the fundamental frequency, namely, $2 \cdot f_E$, $3 \cdot f_E$, . . . , $n \cdot f_E$. However, in variant embodiments, the sound waves $w_2$, . . . , $w_N$ may be waveforms different from pure sinusoidal waves, which are, however, a function of respective multiples of the fundamental frequency, $f_2=2 \cdot f_E$, $f_3=3 \cdot f_E$, . . . , $f_n=n \cdot f_E$, and hence determine, in the frequency domain, respective spectra, the position of which depends upon the respective multiples of the fundamental frequency but the shape of which is different from that of a spectral line; for example, associated to each is a respective spectrum with a given bandwidth.

Hence, the spectral characteristics of the sound waves $w_2$, . . . , $w_N$, in the example, the harmonics of the fundamental frequency depend upon the engine orders, which are precisely those multiples of the frequency of rotation $f_2$, . . . , $f_n$, whereas a parameter k represents the orders that are to be activated, i.e., the values of k of the orders of the engine upon which the generation is to be made to depend, for example k=2, 3, 4. The values of k are integers, but may even be non-consecutive; in any case, the choice of the aforesaid values of k determines the number N of sound waves $W_2$, . . . , $W_N$, which in the example just referred to will be N=4. It should be noted that the sound waves that can be generated are N−1, possibly starting from the one depending upon the second harmonic, if selected. Moreover, the generator 12 receives at input also a set of control parameters, which comprise a signal representing the engine torque, in this case the percentage of travel of the accelerator pedal GP and also a pedal state SP, which indicates whether the accelerator pedal is depressed or not. Moreover, these control parameters at input to the generator 12, which operates also as a function of these parameters, and not only as a function of the fundamental frequency $f_E$ and of the orders k, also comprise an engine state SM, for example indicating whether the engine is a cranking state, an ignition state, a state of stopping and starting, an engine-off state, a stage of warming-up of the engine, etc. As a function of the value of the above control parameters GP and SM, the generator 12 modifies, for example, the amplitude of each sinusoidal harmonic corresponding to a sound wave $w_2$, . . . , $w_N$ by varying the shape of the spectrum corresponding to the set of sound waves $w_2$, . . . , $w_N$.

Hence, to sum up, the module 12 for generating sound waves the characteristics of which depend upon engine orders calculates, as a function of these inputs, N−1 sound waves, $w_2$, . . . , $w_N$, that depend upon the order i ranging from 1 to N, respectively. The sound wave of index i=1, $w_1$, in the example described, would be a sinusoid at the fundamental frequency $f_E$, or in any case a waveform the spectral characteristics of which depend directly upon the frequency determined by the speed of rotation of the engine ER, but is not supplied by the generator 12 at output.

Figure 2:
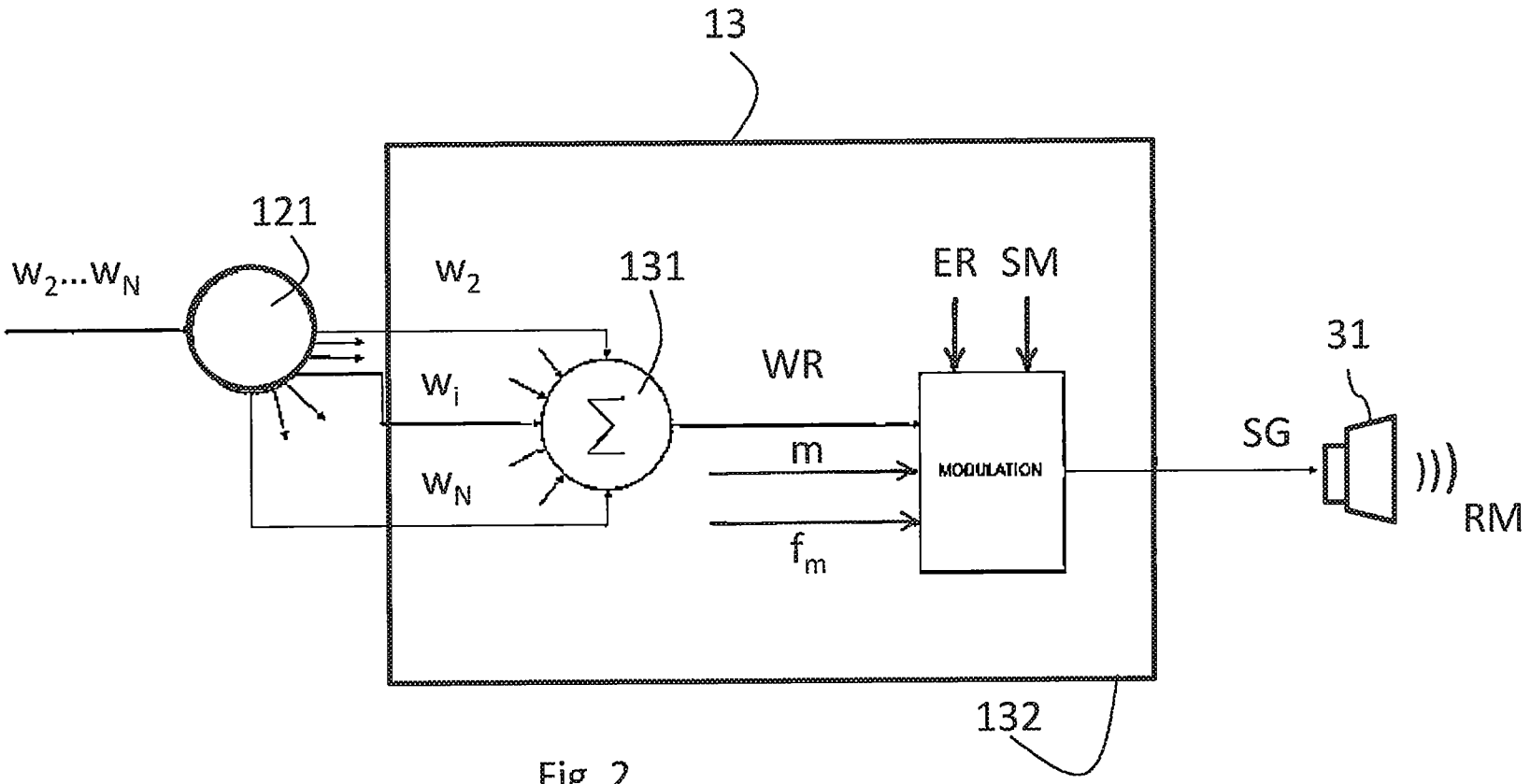
FIG. 2 is a more detailed schematic illustration of a part of the apparatus of FIG. 1.

The above sound waves $w_2$, . . . , $w_N$, i.e., the basic harmonics at output from the generator 12, are supplied at input to a modulator 13, which also receives at input the engine state SM and the active orders k and supplies at output a generated audio signal SG by adding together the harmonics $w_2$, . . . , $w_N$ in a resulting wave, designated by WR in FIG. 2, which is a more detailed illustration of the modulator 13. The resulting wave WR, which in the example is a composition of the basic harmonics $w_2$, . . . , $w_N$, or, more in general, of sound waves, is in turn modulated for controlling the roughness of a generated audio signal SG, which corresponds to the aforesaid resulting wave WR modulated by the modulator 13, as described more fully in what follows.

The generated audio signal SG is an audio signal for driving an acoustic actuator 31, for example a speaker, which, under driving of the aforesaid generated sound signal SG, generates a sound or engine noise RM with the characteristics of roughness and the other psycho-acoustic characteristics associated to the generated sound signal SG.

The modulator 13 operates under the control of modulation parameters represented by a modulation index m and by a modulation frequency $f_m$, the value of which is determined as a function of the engine r.p.m. ER, for example by a vehicle control unit, i.e., a microprocessor module. As has been said, the modulation index m may regard the amplitude modulation or else the frequency modulation (i.e., the deviation in frequency divided by the modulation frequency of the modulating signal). Accordingly, the modulation frequency $f_m$ is the frequency of the modulating signal in the two cases of amplitude modulation and frequency modulation. This makes it possible to set different roughness values for the generated audio signal SG as a function of the engine r.p.m. ER.

In this regard, FIG. 2 illustrates in detail the modulator 13.

The sound waves, i.e., in the embodiment described, the sinusoidal harmonics $w_2$, . . . , $w_i$, . . . , $w_N$, where $w_i$ is the i-th generic harmonic, which are calculated in the sound-wave generator 12 exit from the aforesaid generator 12 each on a different output or wire, the plurality of outputs being represented in the figures via the block 121, and are sent as inputs, which are consequently different from one another, to an adder block 131, which adds together the aforesaid basic harmonics $w_2$, . . . , $w_i$, . . . , $w_N$ to obtain a resulting wave WR. In general, the aforesaid sum is computed also on sound waves other than harmonics. The resulting wave WR, which corresponds to a composition of sound waves that depend upon the respective integer multiples of the frequency of engine r.p.m. $f_2$ to $f_n$, i.e., in the example described here a composition of sinusoidal harmonics of the fundamental frequency $f_E$, is used as carrier wave and supplied at input to a modulation block 132, which applies to the aforesaid carrier, i.e., resulting wave WR, a modulation with characteristics defined by the modulation index m and by the modulation frequency $f_m$, supplied at input to the modulator 132, for example, as has been said, by a vehicle control unit.

The values of the aforesaid modulation characteristics, namely, the modulation index m and the modulation frequency $f_m$, used by the modulation block 132 for obtaining a certain value of roughness R also depend upon the engine r.p.m. ER and the engine state SM, which represents a state or condition of the vehicle. In the figures, the aforesaid dependence is indicated, with a dashed arrow, by two inputs to the modulation block 132; however, in a preferred version, the modulation index m and the modulation frequency $f_m$ are regulated in the module, for example the control unit 33 represented in FIG. 6, that supplies just the modulation index m and the modulation frequency $f_m$ to the block 132. In variant embodiments, the block 132 may be configured, via a processor or a look-up table, for correcting autonomously the modulation index m and the modulation frequency $f_m$ as a function of the engine r.p.m. ER and of the engine state SM received directly by the block 132.

Hence, corresponding to different vehicle conditions are different degrees or levels of roughness R in the generated audio signal SG. This consequently makes it possible to choose different degrees or levels of roughness R in the generated audio signal SG as a function of the engine r.p.m. ER. Also in this case, the engine state SM may be an optional parameter.

It is emphasised how in general the apparatus described may be used by a user who manually enters the roughness values R (or fluctuation strength). Alternatively, the user can also use the apparatus described herein by manually entering values of modulation index and modulation frequency.

Figure 3:
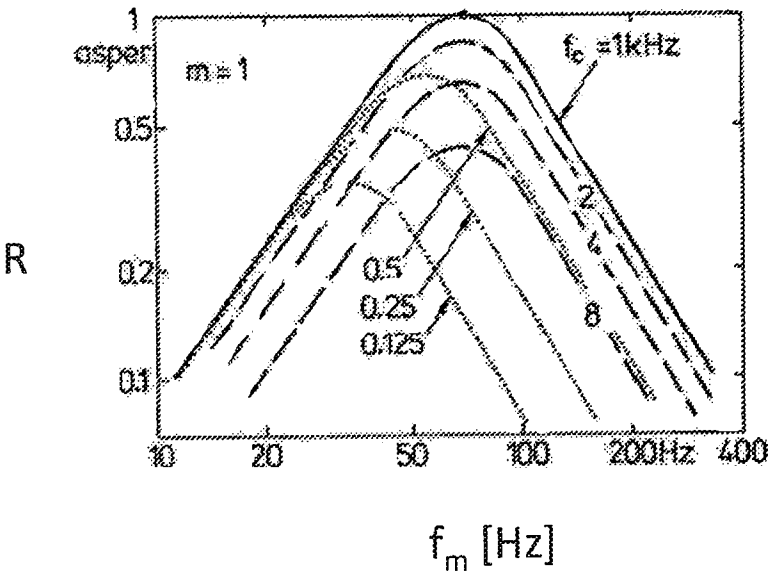
FIG. 3 shows a diagram representing values of a quantity to be reproduced through the apparatus described herein.

In this regard, FIG. 3 represents the variation of the roughness R as a function of the modulation frequency $f_m$ for a value of modulation index m=1, as well as of a central frequency $f_c$ of the tone, i.e., the frequency of the carrier of the resulting wave WR. The aforesaid diagram is in itself known and appears, for example in the publication by E. Zwicker, H. Fastl, "Psychoacoustics. Facts and Models" Springer-Verlag, Berlin, 1990.

In general, in the vehicle control unit or the block 132, given a roughness value R of the generated audio signal SG to be obtained via modulation of the resulting signal WR, it is, for example, envisaged to access a table, obtained on the basis of diagrams like that of FIG. 3, which, as a function of the roughness value R, of the central frequency $f_c$ of the tone, i.e., the frequency of the carrier of the resulting wave WR to be obtained, and possibly of the values of engine r.p.m. ER and engine state SM, supplies the values of modulation index m and modulation frequency $f_m$ to be applied to the resulting wave WR.

In general, the apparatus described herein generates the sound of the engine orders, for example the sinusoidal harmonics $w_2, \ldots, w_i, \ldots, w_N$, and applies to the combination of the orders, i.e., to the resulting signal WR as just described, or else to each order, a calibratable, or adjustable, level of roughness R (or fluctuation strength) obtained via modulation. In this way, the sound of the vehicle is completely and directly designed for generating a calibratable set of engine orders and for defining, through calibration, a predefined level of roughness. The level of roughness may be calibrated or adjusted directly via a setting made by the user of the roughness value R and a conversion, carried out by the apparatus, of the current engine r.p.m. into a modulation frequency and a modulation depth—or a number of values of modulation frequency and modulation depth, as explained with reference to the embodiment of FIG. 5. The aforesaid level of roughness R can also be calibrated or adjusted on the basis of other conditions of the vehicle.

Moreover, it is to be considered that, especially when operating with tones, i.e., resulting waves WR, with central frequencies $f_c$ lower than 1 kHz, the maximum roughness is achieved with different frequency modulations at different central frequencies $f_c$ of the carrier of the resulting wave WR.

Figure 4:
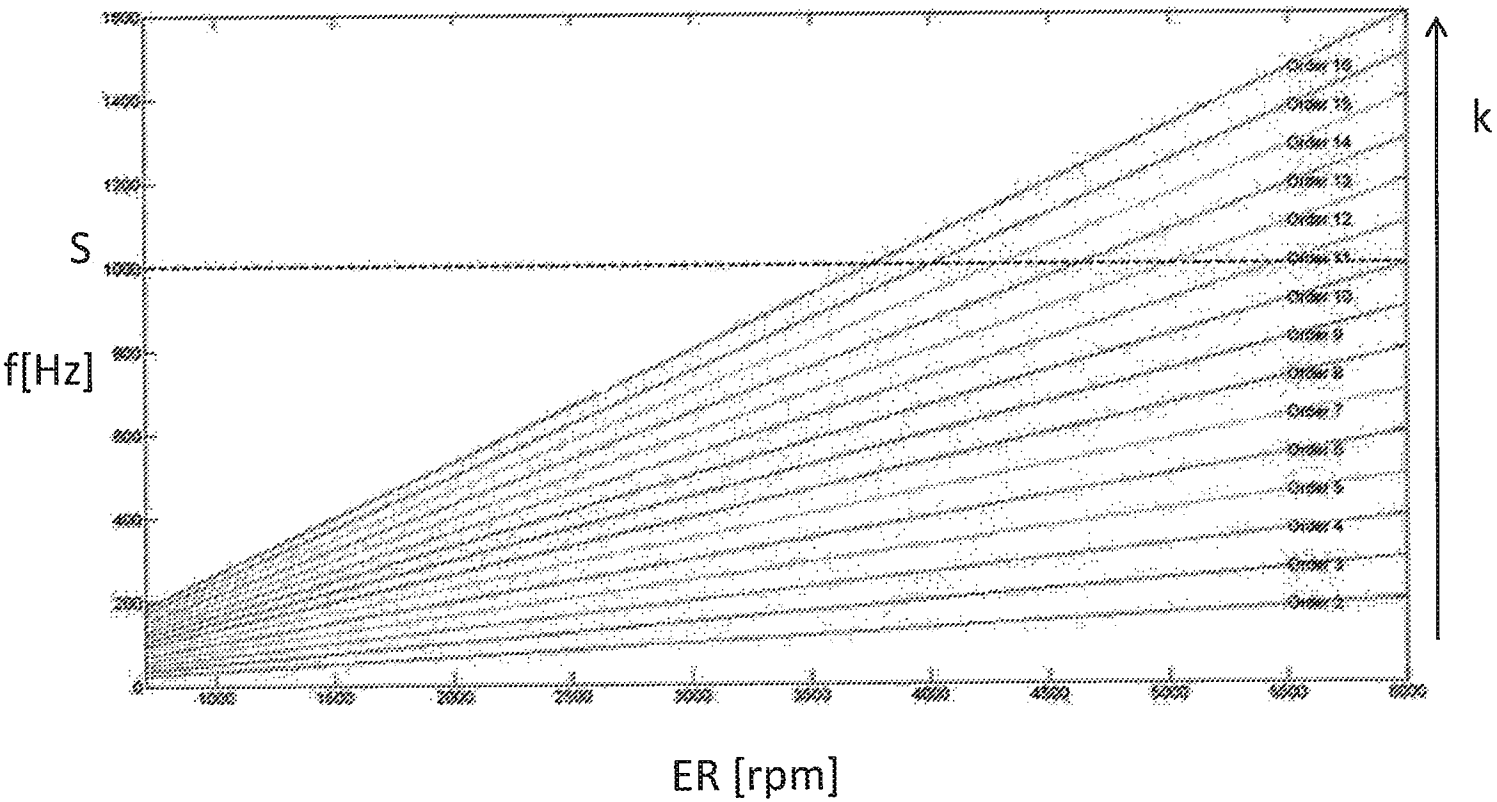
FIG. 4 shows a diagram representing values of a further quantity to be reproduced through the apparatus described herein.

In this regard, FIG. 4 shows the plot of the frequency of the orders k, from the second order to the sixteenth order, of the engine as a function of the engine r.p.m. ER, the frequency increasing linearly with the latter.

It may be noted from FIG. 4 how, in the case of the sound of an engine of a land vehicle, at the frequencies below a threshold S of 1 kHz all the orders are in general present, whereas beyond that threshold S only the frequencies of higher order are present, for example of an order k higher than 10. This means that, for a wide range of orders, to reach the maximum value of roughness it is necessary to assign different values of modulation frequency $f_m$ to different orders.

Figure 5:
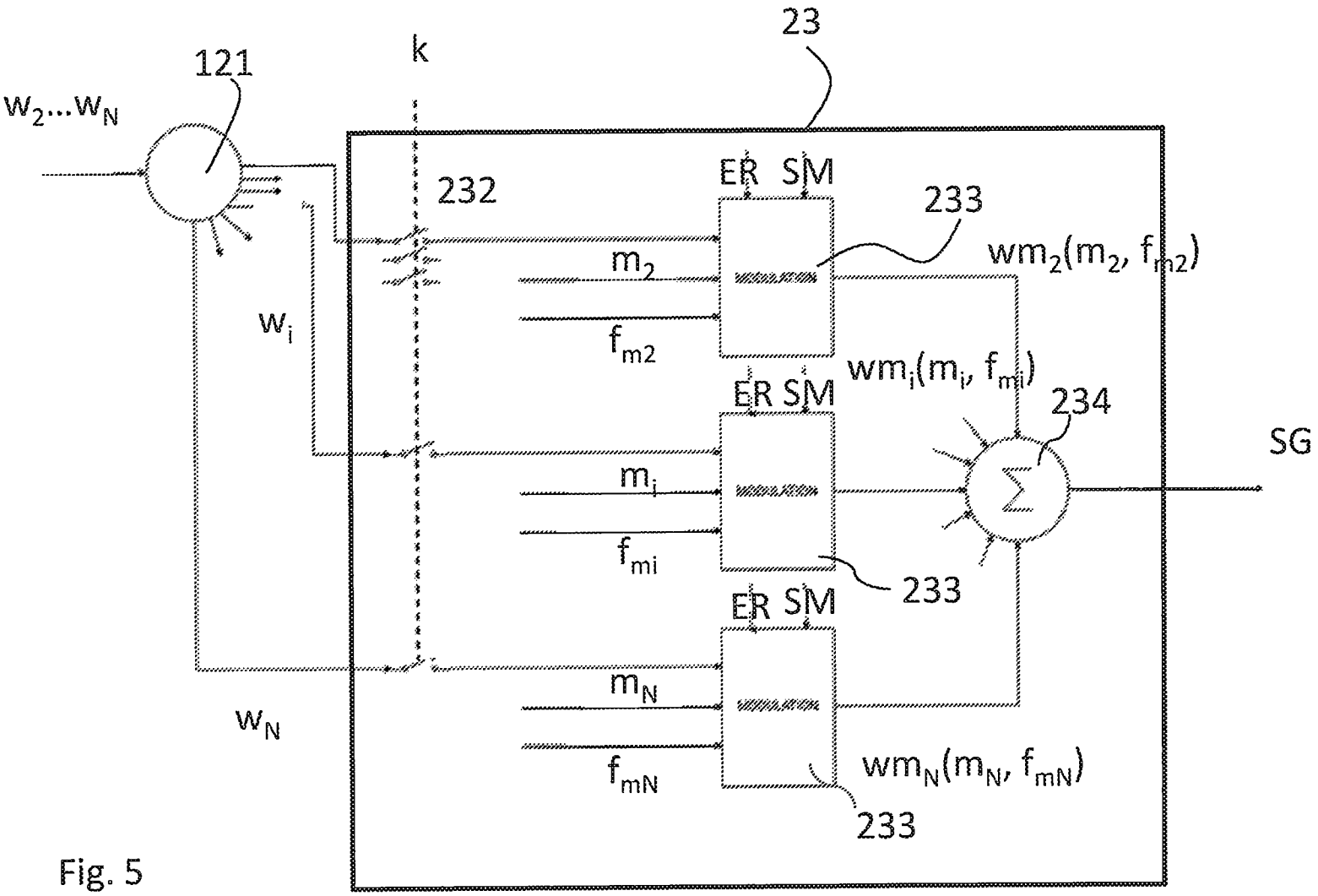
FIG. 5 is a schematic illustration of a further embodiment of the apparatus described herein.

In this regard, FIG. 5 presents a block diagram of a variant embodiment 23 of the block 13, which comprises a modulator 232 that makes it possible to assign different values of modulation frequency $f_m$ to different orders.

The above embodiment includes switches 133 arranged on each of the wires 121 at output from the generator 12, which make it possible to select each basic sinusoidal harmonic $w_i$ and send it to a respective modulation block 233, which receives at input a respective modulation index $m_i$ and a respective modulation frequency $f_{mi}$ and supplies at output a respective modulated basic sinusoidal harmonic $wm_i$ ($m_i$, $f_{mi}$). The aforesaid respective modulated basic sinusoidal harmonic $wm_i$ is sent to an adder 234, which in this case, unlike in the case of the modulator 13, is hence located downstream of the modulator block 233, where it is added to the other modulated basic sinusoidal harmonics independently, obtaining as sum the generated audio signal SG, which is a composition of basic sinusoidal harmonics, in this case already modulated. As mentioned previously, the i-th modulation index $m_i$ and the i-th modulation frequency $f_{mi}$ depend upon the engine r.p.m. ER and possibly upon the engine state SM, these being parameters that, as in the case of the modulator 13, may be evaluated in the modulator 23 or in a vehicle control unit. Hence, each i-th order is modulated with different characteristics. The parameter k that indicates the active engine orders makes it possible to select which harmonics originated by the generator 12 to use.

Also in this case, in the vehicle control unit or in the block 233, it is envisaged for example, given a value of roughness R (or fluctuation strength) of the generated audio signal SG to be obtained via modulation of the basic sinusoidal harmonics $w_i$, to access a table, obtained on the basis of diagrams like that of FIG. 3, which, as a function of the value of roughness R, of the central frequency $f_c$ of the tone of the signal to be obtained SG, and possibly of the values of engine r.p.m. ER and engine state SM, supplies the values of modulation index $m_i$ and modulation frequency $f_{mi}$ to be applied to the basic sinusoidal harmonics $w_i$, which, hence, added together as modulated basic sinusoidal harmonics $wm_i$ ($m_i$, $f_{mi}$) in the block 234, give rise to a generated audio signal SG with the aforesaid given value of roughness R.

Of course, in a similar way, in the case where the sound waves $w_2, \ldots, w_N$ are represented by waveforms different from basic sinusoidal harmonics, for example sound textures or wavelets, the method likewise envisages sending each sound wave to a respective modulator, which applies a modulation of its own, producing modulated sound waves, which are then added together to obtain a composition of modulated waves.

In order to achieve the maximum value of roughness R, i.e., the maximum of the curves of FIG. 3, the modulation frequency $f_m$ and the modulation index m must be functions of the carrier frequency $f_c$, which, for a given i-th modulation block 233, corresponds to the frequency of the i-th harmonic $w_i$ calculated as a function of the engine r.p.m. ER, for example according to the diagram appearing in FIG. 4.

It is emphasised how the modulator 23 may not necessarily be used for obtaining the maximum value of roughness R in so far as the plurality of modulation blocks 233 may also enable regulation of the roughness R of the generated signal SG on a wider range of roughness values, the reason being that the apparatus generally regulates the value of roughness by modifying the modulation values.

In addition, the modulator 233, in particular each modulation block 232, may be configured as a function of the engine states SM, for example, the cranking state, the ignition state, the state of stopping and starting, the engine-off state, the state of warming-up of the engine, etc., the reason being that in the different engine states SM different vehicle conditions are present to which different sounds are associated.

The modulation index and the modulation frequency are hence preferably functions of the engine states SM, both in the embodiment of FIG. 2 and in the embodiment of FIG. 5.

In the various embodiments, the apparatus also controls the fluctuation strength associated to the generated audio signal SG. In this case, since the fluctuation strength is defined for lower frequencies than roughness, in particular as low as 20 Hz, accordingly lower modulation frequencies are used to obtain the typical sensations associated to the fluctuation strength. The apparatus described sends the generated audio signal SG into the passenger compartment of the land vehicle and/or into the exhaust line. This is preferably obtained by superimposing on the original sound of the vehicle, which propagates in the passenger compartment and/or in the exhaust line, a synthetic sound, i.e., the sound of the engine RM, generated by the apparatus described herein, which is a function of the engine r.p.m. ER, in addition to other parameters, as described, comprising engine state SM, and/or torque (accelerator-pedal position and/or state), to obtain specific psycho-acoustic characteristics, in particular the roughness and possibly the fluctuation strength, which yield a specific desired sensation, for example a sensation similar to that created by the noise of a sports-car engine.

Preferably, the apparatus described herein may be implemented by configuring a microprocessor module using software, for example the dedicated ECU, namely, the ASM (Active-Sound Module), or other ECUs, or else may be implemented in the audio/infotainment system of the vehicle 30.

The apparatus for active control of the sound of the engine described herein may be used both for vehicles with internal-combustion engines and for electric vehicles.

Figure 6:
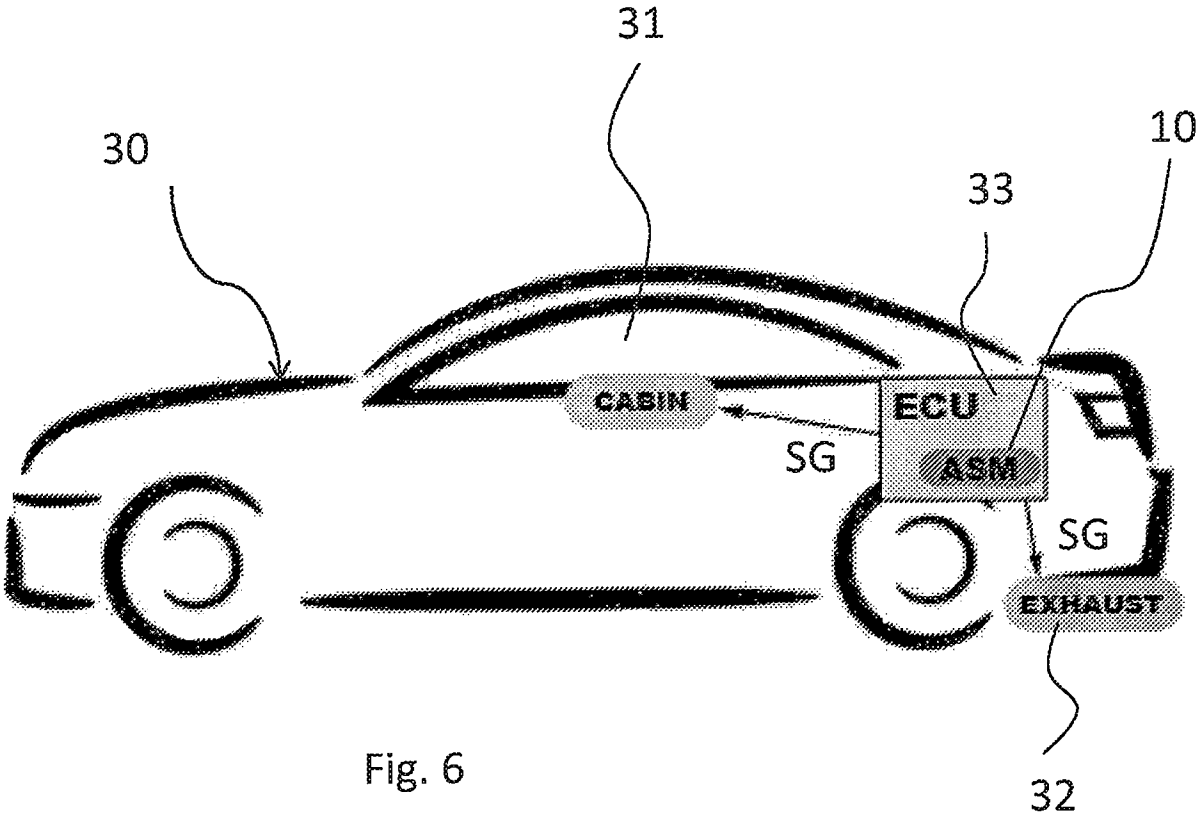
FIG. 6 is a principle diagram representing implementation of the apparatus described herein on a land vehicle.

FIG. 6 illustrates an example of installation of the apparatus 10 that is implemented via software in an ECU 33 of a motor vehicle 30 and drives, via a driving signal SG, both an acoustic actuator 31, in the passenger compartment of the motor vehicle 30, and an acoustic actuator 32 in the exhaust line, which are, for example, both speakers or shakers for emitting the sound of the engine. In variant embodiments, the generated audio signal SG may be modulated differently according to the acoustic actuator to which it is sent, and also the actuators in one and the same context, for example in the passenger compartment, can receive different generated audio signals SG; for example, the right-hand speaker in the passenger compartment may receive a sound to be reproduced that is different from the one received by the left-hand speaker in the passenger compartment.

Hence, from what has been described above, the advantages of the solution proposed emerge clearly.

The solution described advantageously envisages direct introduction of the roughness as a separate function by applying a modulation to the sound generated. In other words, the solution described does not call for the need to introduce the dependence, for example, upon half-integer orders, of the engine for generating an aggressive engine noise, but can directly carry out a modulation to obtain the desired roughness values.

The solution described herein advantageously enables modification of the sound of the engine by generating an actual engine sound, both in the passenger compartment and in the exhaust line.

The solution described may be advantageously applied both to internal-combustion engines and to electric engines, as well as to vehicles with hybrid propulsion systems.

In the case of application to vehicles with internal-combustion engine, the sound generated by the apparatus and method described herein combines with the sound of the internal-combustion engine, whereas, in the case of application to pure electric-drive vehicles, the sound of the vehicle is, in actual fact, the sound generated.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. An apparatus for active generation of a sound of an engine of a land vehicle, said apparatus including a device for detecting a fundamental frequency of the sound of the engine, a generator for generating signals corresponding to waveforms representing sound waves that have spectral characteristics that depend upon said fundamental frequency and are positioned at multiples of said fundamental frequency, and a modulator including a module that modulates said waveforms representing sound waves by modifying a modulation index and a modulation frequency of the modulation module so as to control the obtaining of a determined a value of roughness or fluctuation strength of an audio signal for driving an actuator that generates an engine noise;

said modulator including a module that modulates said waveforms representing sound waves, and includes a plurality of sub-modules for modulating each sound wave with characteristics that depend upon a i-th multiple of the fundamental frequency, each sub-module being governed by a respective modulation index and a respective modulation frequency, and which receives at input said waveform representing a sound wave, selected to supply at output a respective modulated waveform representing a sound wave; and an adding module which adds together said modulated waveform representing sound waves so as to control the value of roughness and/or fluctuation strength of an audio signal to supply at output said audio signal for driving an actuator that generates an engine noise.

2. The apparatus as set forth in claim 1, wherein said device for detecting a fundamental frequency of the sound of the engine includes a converter for converting the engine r.p.m. into a value of fundamental frequency.

3. The apparatus as set forth in claim 1, wherein said modulator comprises an adding module that adds together said waveforms representing sound waves generated by the generator to obtain a resulting wave, and said module that modulates said waveforms representing sound waves further modulates said resulting wave so as to control the value of roughness or fluctuation strength of an audio signal for driving an actuator that generates a noise of the engine.

4. The apparatus as set forth in claim 1, wherein said module that modulates said resulting wave operates under control of a modulation index and of a modulation frequency, which are determined as a function of the engine r.p.m.

5. The apparatus as set forth in claim 2, wherein said modulator sends different values of modulation index and modulation frequency as a function of an engine state.

6. The apparatus as set forth in claim 1, wherein said modulation is an amplitude modulation and said modulator controls the roughness or fluctuation strength of said audio signal as a function of an amplitude-modulation index and an amplitude-modulation frequency.

7. The apparatus as set forth in claim 1, wherein said modulation is a frequency modulation, and said modulator controls the roughness of said audio signal as a function of a frequency-modulation index and a modulation frequency of a modulating signal of said modulator.

8. The apparatus as set forth in claim 1, wherein said apparatus sends said audio signal for driving an actuator that generates an engine noise to one or more acoustic actuators arranged in a passenger compartment of a land vehicle and/or in an exhaust line of the vehicle a corresponding actuator overlaying on an original sound of the vehicle a sound generated under driving of said audio signal for driving an actuator that generates an engine noise.

9. The apparatus as set forth in claim 1, wherein said apparatus is implemented in a microprocessor module of the land vehicle or other ECUs available on board the land vehicle.

10. The apparatus as set forth in claim 1, wherein said generator of signals representing sound waves that have spectral characteristics that depend upon said fundamental frequency comprises a generator of harmonics, which generates harmonics of sinusoidal waves as a function of said fundamental frequency, and said modulator applies a modulation to said harmonics of sinusoidal waves.

11. The apparatus as set forth in claim 1, wherein said apparatus is arranged in a vehicle with internal-combustion engine or in an electric or hybrid vehicle.

12. The apparatus as set forth in claim 1, wherein said module that modulates waveforms representing sound waves is configured, given a value of roughness or fluctuation strength of the generated audio signal to be obtained, for accessing a table, which, as a function of at least said value of roughness or fluctuation strength of a central frequency of the generated audio signal, supplies corresponding values of modulation index and modulation frequency to be applied to said waveforms.

13. A method for active generation of a sound of an engine of a land vehicle, which comprises converting the engine r.p.m. into a value of fundamental frequency and generating sound waves, in particular sinusoidal harmonics, as a function of said fundamental frequency, wherein the land vehicle includes a modulator having a module that modulates waveforms representing sound waves, and includes a plurality of sub-modules for modulating each sound wave with characteristics that depend upon a i-th multiple of the fundamental frequency, each sub-module being governed by a respective modulation index and a respective modulation frequency, and which receives at input the waveform representing a sound wave, selected to supply at output a respective modulated waveform representing a sound wave; and an adding module which adds together the modulated waveform representing sound waves;

said method including the step of modulating said sound waves so as to control a value of roughness or fluctuation strength of an audio signal for driving an actuator, which generates an engine noise.

14. The apparatus as set forth in claim 1, wherein said waveform representing a sound wave is a sinusoidal harmonic of said fundamental frequency and said modulated waveform representing a sound wave is a modulated harmonic of said fundamental frequency.

15. The apparatus as set forth in claim 12, wherein the modulation index and modulation frequency are defined in order to obtain a determined amount of roughness in the resulting sound.

* * * * *